US006269503B1

(12) United States Patent
Betker

(10) Patent No.: US 6,269,503 B1
(45) Date of Patent: Aug. 7, 2001

(54) DIAPER CHANGING STATION WITH PRERECORDED VOICE INSTRUCTIONS

(75) Inventor: Mark A. Betker, Castle Rock, CO (US)

(73) Assignee: Koala Corporation, Denver, CO (US)

( * ) Notice: Subject to any disclaimer, the term of this patent is extended or adjusted under 35 U.S.C. 154(b) by 0 days.

(21) Appl. No.: 09/513,708

(22) Filed: Feb. 25, 2000

Related U.S. Application Data

(60) Provisional application No. 60/121,890, filed on Feb. 26, 1999.

(51) Int. Cl.[7] ..... A61H 1/00
(52) U.S. Cl. ..... 5/655; 5/947
(58) Field of Search ..... 5/655, 940, 947

(56) References Cited

U.S. PATENT DOCUMENTS

D. 314,112 1/1991 Dainty ..... D6/555
4,066,072 * 1/1978 Cummins ..... 5/655
5,357,642 * 10/1994 Clute ..... 5/655
5,411,457 * 5/1995 Hartdegen, III et al. ..... 5/655

OTHER PUBLICATIONS

Solutions for Family Friendly Facilities, 1999 Koala Catalog.

The Clegg Voice Box, Clegg Industries, Inc., 1997 Clegg Industries Catalog.

* cited by examiner

*Primary Examiner*—Lynne H. Browne
*Assistant Examiner*—Fredrick Conley
(74) *Attorney, Agent, or Firm*—Sheridan Ross P.C.

(57) ABSTRACT

A diaper changing station is provided which incorporates voice and/or video instructions in any variety of languages and is activated by a motion detector, manual depression of a button or by lowering the changing platform to a position of use.

19 Claims, 5 Drawing Sheets

DIAPER CHANGING STATION WITH PRERECORDED VOICE INSTRUCTIONS

This application claims priority of U.S. provisional patent Application Serial No. 60/121,890 having a filing date of Feb. 26, 1999 and being incorporated herein in its entirety by reference.

FIELD OF THE INVENTION

This invention relates generally to the field of baby changing stations that may be mounted to a wall or alternatively to counter top surfaces and more specifically baby changing stations which incorporate an audio module which provides instructions or other data to a user.

BACKGROUND OF THE INVENTION

Baby changing stations are used predominantly in public restrooms such as airports, restaurants and grocery stores to assist parents who are changing a baby's soiled diaper. The changing stations are typically mounted on a vertical wall, or alternatively to a horizontal planer surface such as a counter top. In use, a typical changing station requires the changing platform to be folded down to a position of use, a sanitary material placed over the surface on which the baby is positioned, and a restraining harness secured to the baby for safety purposes. Unfortunately, many types and designs of diaper changing stations exist with different features and modes of operation. Thus, it would be beneficial for the instructions of use to be provided in a voice messaging system which would quickly and efficiently provide instructions to illiterates, the blind, and others which have difficulty understanding the use of such an apparatus.

SUMMARY OF THE INVENTION

The object of the present invention is to provide a diaper changing station which has a prerecorded audio message which provides specific instructions regarding the proper use of the diaper changing station or other informational data. In one embodiment of the present invention the voice message is activated upon the lowering of the changing bed of the diaper changing unit. Alternatively, the voice message may be activated by a manually depressed switch or lever, or by a motion sensor that detects that a user is approaching the diaper changing station.

Thus, in one aspect of the present invention, a diaper changing station with prerecorded voice instructions is provided which comprises an attachment section adapted for securement to a vertical surface; a changing station platform pivotally connected to said first section which travels between a first closed position and a second open position of use, wherein in said second open position said changing platform is in a substantially horizontal position for supporting an infant, means for providing an audio message comprising a means for storing said audio message and a triggering mechanism and a speaker which may or may not be interconnected to the diaper changing station.

DETAILED DESCRIPTION OF THE DRAWINGS

DETAILED DESCRIPTION OF THE INVENTION

Figure 1:
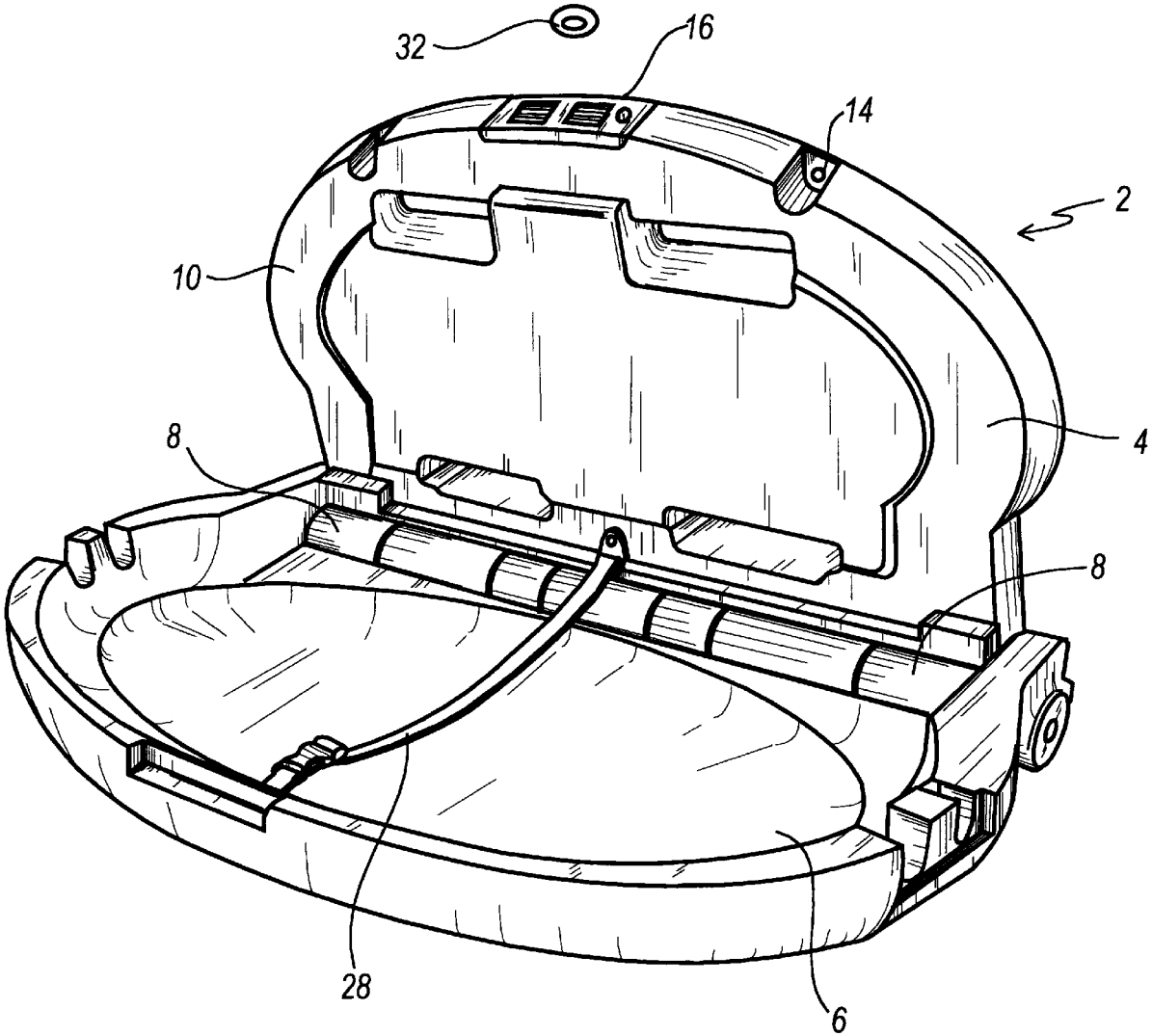
FIG. 1 is a front perspective view of a horizontal diaper changing station, shown with the support platform in an open position of use.

This invention discloses a diaper changing station 2 which incorporates an audio or video module 16 incorporated into the apparatus or alternatively in a location positioned proximate to the apparatus. These diaper changing stations 2 are typically found in public restrooms. The audio or video module 16 generally includes at least one microprocessor, recording medium, speaker and triggering mechanism to activate and deactivate the various functions. The audio or video module 16 is capable of allowing one to create a customized message, to select from one or more prerecorded messages or to readily and repeatedly change a message. It is a flexible system that may even allow the end user to select from among the prerecorded messages, and to select from a variety of languages depending on the nationality of the user. The actual audio or video messages may provide instructions for use of the product, information regarding the product's features and characteristics, information regarding other complimentary products, or any other informational or promotional message which may be useful in a retail or commercial setting.

The audio or visual message is initiated by a suitable triggering mechanism. This can be a simple on/off switch or a more complicated motion detector 32 that initiates the message upon the detection of any movement within a prescribed range. Alternatively a push-button activated switch 34 may be provided which may be activated on demand. Preferably, the triggering mechanism is activated by one using the product or by opening the support platform for use.

Figure 2:
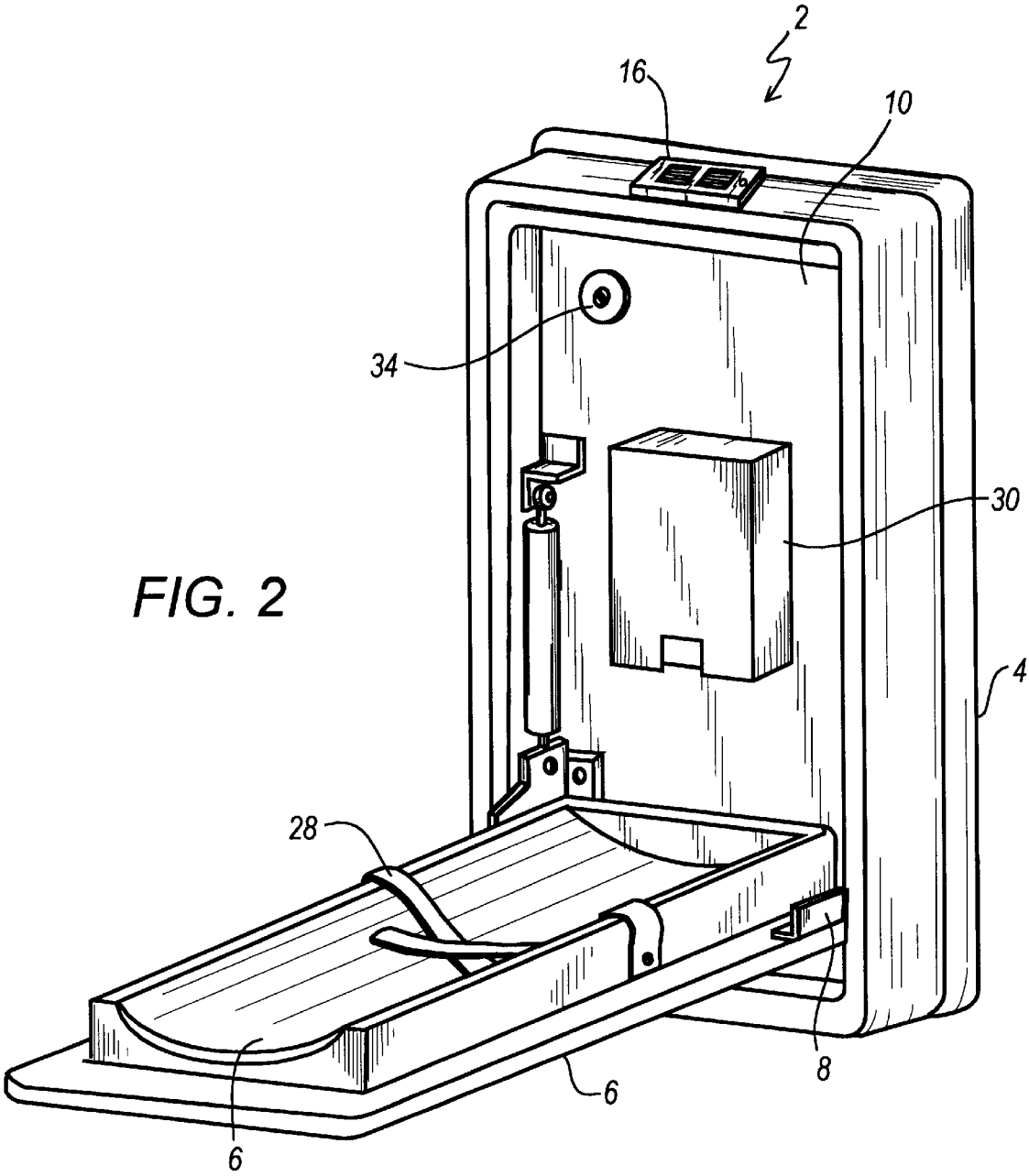
FIG. 2 is a front perspective view of a vertical diaper changing station, shown with the support platform in an open position of use.
Figure 3:
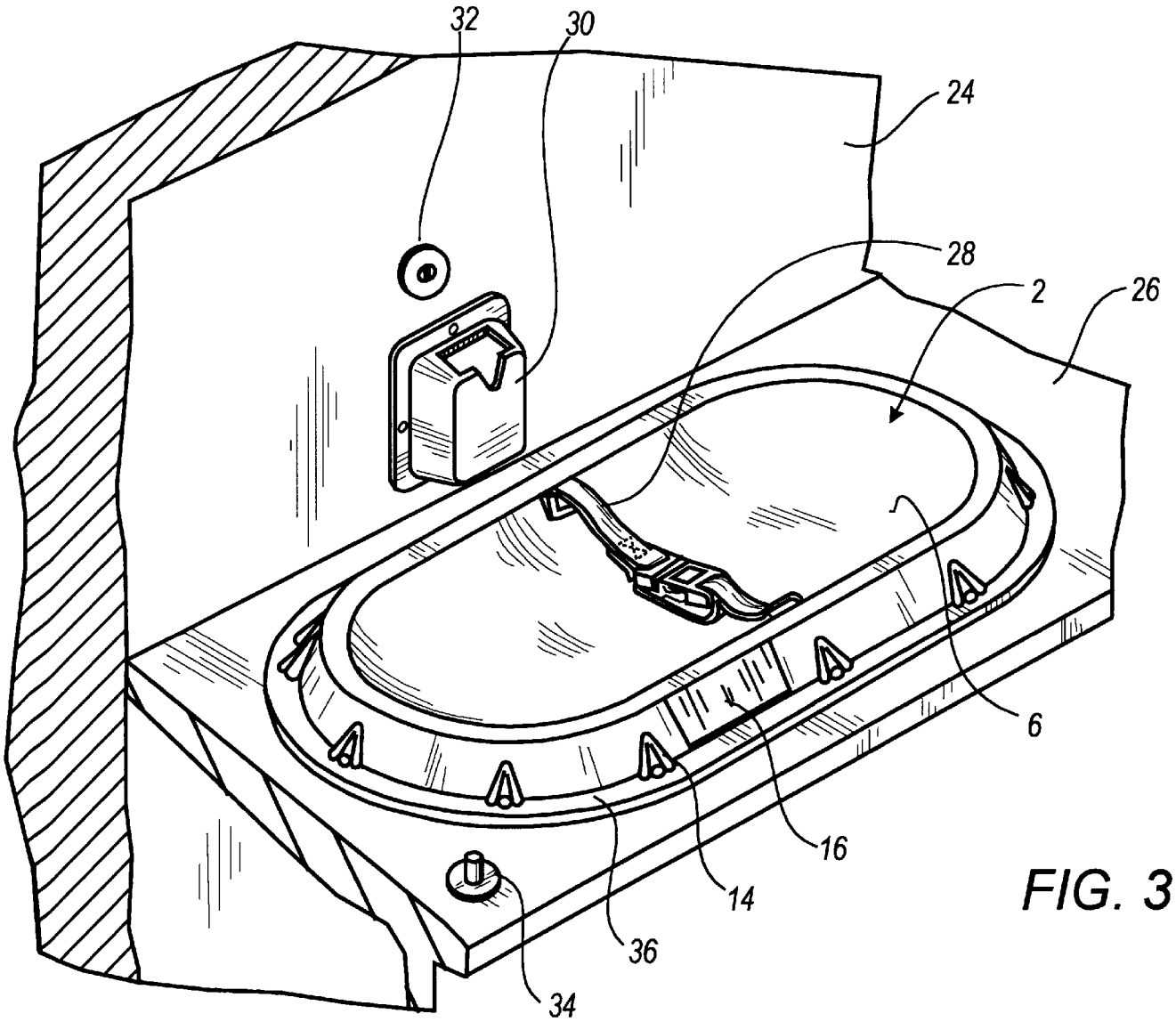
FIG. 3 is a front perspective view of a counter-top diaper changing station shown installed on a typical counter top.

Referring now to FIGS. 1–3, a variety of different types of infant changing stations 2 are provided. FIG. 1 depicts a "horizontal" diaper changing station which mounts to a vertical wall surface, while FIG. 2 depicts a "vertical" diaper changing unit. FIG. 3 depicts a typical "counter-top" diaper changing station which is attached to the top of a typical counter-top. A conventional wall mounted baby changing station as seen in FIGS. 1 and 2 generally includes two primary components: 1) a first attachment member 4 that is mounted onto a wall; and 2) a movable support platform 6 that is interconnected to the first attachment member 4 by a hinge mechanism 8 to provide a horizontal surface for supporting the baby. As shown in FIG. 1, a conventional wall mounted baby changing station 2 is installed onto a vertical surface, such as a public restroom wall. When not in use, the baby changing station 2 is designed to be in a closed position, i.e., where both the attachment member 4 and the support platform 6 are both aligned parallel to the vertical wall. This feature saves considerable space in the closed confines of a public restroom. To use the baby changing station 2, one pulls the upper end of the support platform 6 downward from the vertical wall attachment member 4, as allowed by the hinge 8 between the two sections, to a secure position of use which is parallel to the floor. A baby may then be placed on the horizontal surface to change a soiled diaper. As seen in FIGS. 1–3, a typical diaper changing station will also include a safety restraining strap 28 and a sanitary liner dispenser 30.

Figure 4:
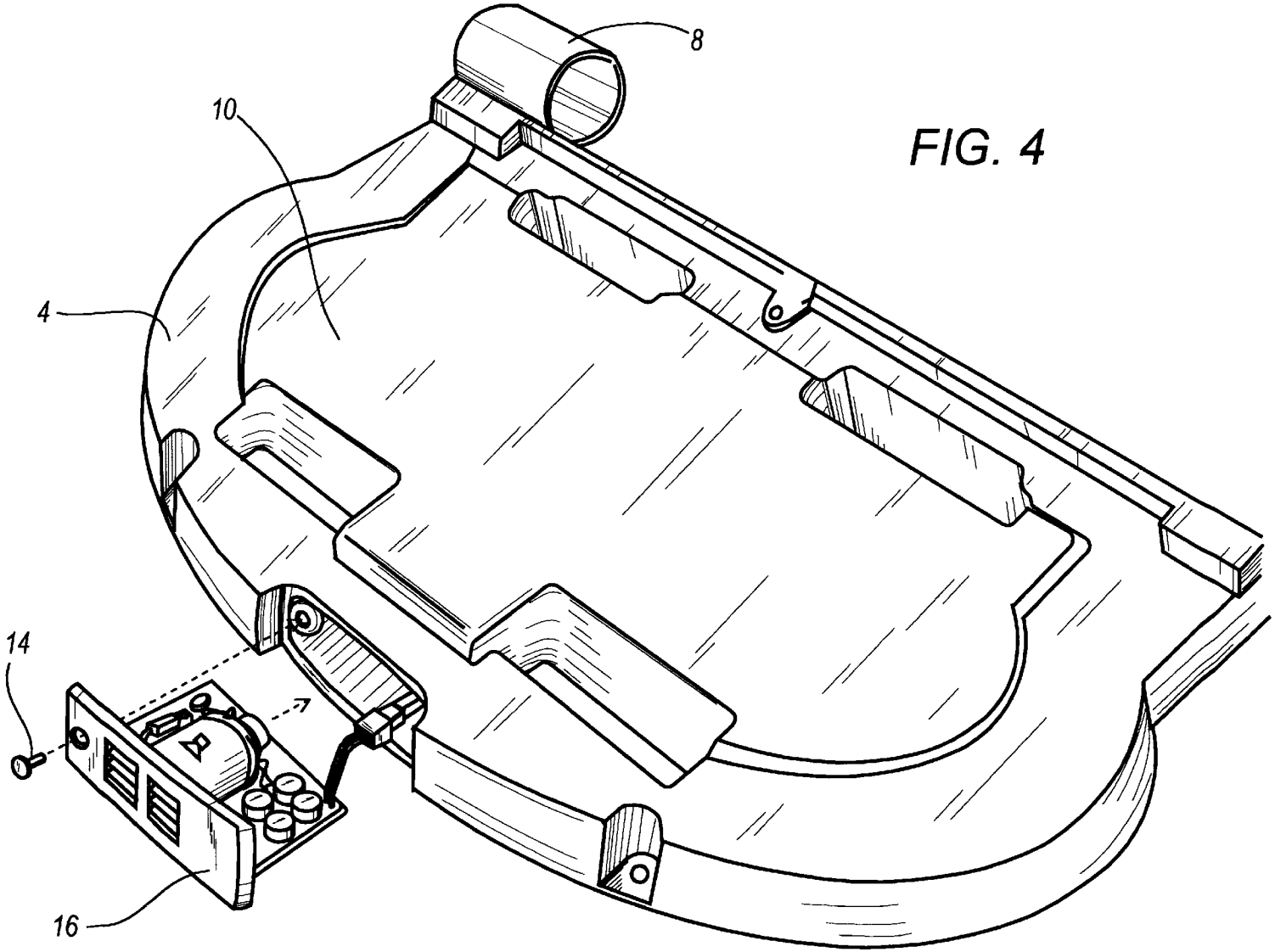
FIG. 4 is a top perspective view of the attachment member shown in FIG. 1, and more specifically showing the voice module removed from the upper edge of the attachment member.
Figure 5:
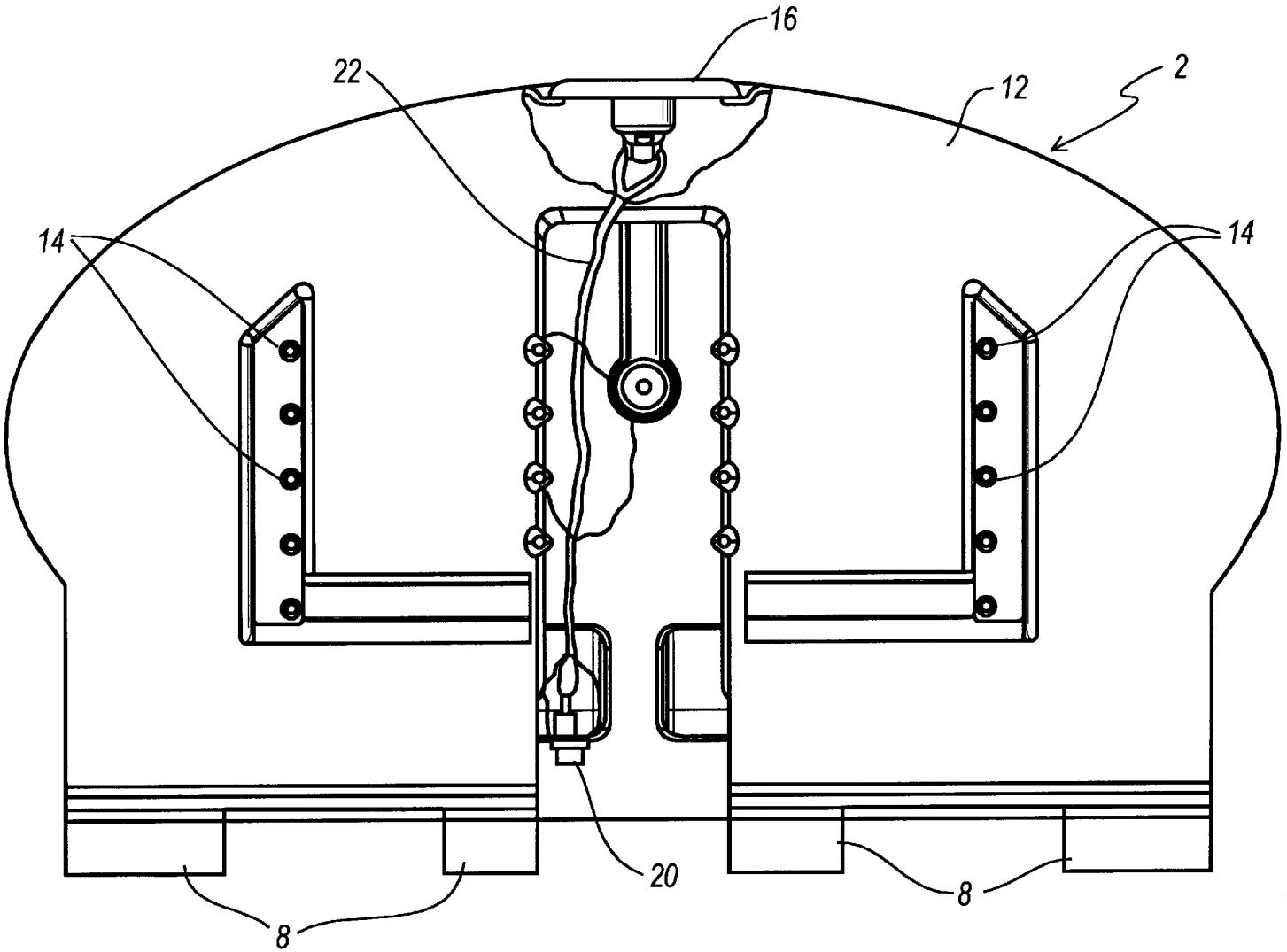
FIG. 5 is a rear elevation view of the attachment member shown in FIG. 1, and further identifying the placement of the voice module, plunger and conductor wire.

Referring now to FIGS. 4 and 5, an audio module 16 is provided with a baby changing station 2 to provide a prerecorded voice or visual message which preferably is triggered by opening and closing the unit. That is, when the unit is opened by moving the support platform 6 away from the attachment member 4, a button switch 20 is released to trigger the playing of the audio message. While the unit is opened, the audio message is played through once in its entirety or, alternatively, continually played until the unit is closed. When the unit is closed, the button switch is depressed, deactivating the audio module. Preferably, the entire audio module, including the button switch, microprocessor and speaker, is all contained within the attachment member 4 as seen in FIG. 4. If repairs or an entirely new unit is required, the audio module 16 can easily be replaced by an alternative unit. Preferably, the button switch 20 is located within the attachment member 4 near the hinges 8 between the attachment member 4 and support platform 6 and the audio speaker is located near the outer, top surface of the attachment member 4. Alternatively, a push button activation switch 34 or motion sensor 32 can be utilized to activate the playing of the voice message. For example, as seen in FIG. 1, a motion sensor 32 may be positioned on the vertical wall surface, or alternatively directly, on the diaper changing station 2. Alternatively, a push button 34 may be mounted adjacent the changing station 2, as seen in FIG. 3, or alternatively mounted directly on the changing station 2 as seen in FIG. 2.

Where the triggering mechanism is positioned near the hinge 8 as shown in FIGS. 4 and 5, a conductor 22 generally interconnects the plunger 20 and the voice module 16.

The voice module 16 is generally powered by batteries, although the unit may be interconnected to a typical 120V AC current. Generally, the voice module 16 comprises at least a speaker, a recording medium such as audio tape and a mechanism to repeatedly play, rewind and replay the recorded message. Alternatively, a digital recording mechanism such as a computer microchip can be used which can be programmed to play different messages in a variety of languages. These types of products are known by those skilled in the art, and various types of these products such as the Clegg Voice Box are sold by the Clegg® Corporation of Torrance, Calif. Alternatively, a small microprocessor or personal computer can be used for the same purpose and to provide expansion capabilities such as count legal tender and provide change where a fee is charged to use the diaper changing station 2.

For a wall mounted baby changing station 2, the audio message is preferably a set of instructions and warnings regarding the proper use of the product. However, additional audio and/or video messages may be used instead of, or together with, such instructions and warnings. For example, wall mounted baby changing stations are commonly installed in retail stores and restaurants, whose managers may wish to use the audio and/or video message to promote their products and services. Similarly, wall mounted baby stations in public restrooms, such as in post offices, bus stations, airports, parks and government buildings, may be a revenue source by providing an advertising medium for third parties. Other substitute or complimentary audio and/or video messages may be appropriate in other settings where wall mounted baby changing stations are installed, such as churches or charitable organizations.

Another embodiment of the present invention discloses the incorporation of an audio and/or video module into the packaging of a product at the point of sale. The triggering mechanism is preferably a button or switch that an interested, prospective purchaser moves to activate the audio and/or video message. As set forth above, other triggering mechanisms may be employed, including a motion detection device and a hidden on/off switch triggered by opening the packaging or part of the packaging.

For a packaging application, the audio and/or video message preferably promotes the features of the product contained therein, such as its function, structure, sizes, colors, price or any other advantageous characteristic. However, additional audio and/or video messages may be used instead of, or together with, such information. For example, it may include the existence, availability, store location and characteristics of other, complimentary products.

While various embodiments have been described in detail, it is apparent that modifications and adaptations of those embodiments will occur to those skilled in the art. However, it is to be expressly understood that such modifications and adaptations are within the scope of the present invention.

To provide further clarity to the detailed description provided herein in the associated drawings, the following list of components and associated numbering are provided as follows:

| Component No. | Component |
|---|---|
| 02 | Diaper Changing Station |
| 04 | Attachment Member |
| 06 | Support Platform |
| 08 | Hinge |
| 10 | Attachment Member Front Side |
| 12 | Attachment Member Rear Side |
| 14 | Attachment Hardware |
| 16 | Audio Module |
| 20 | Button/Plunger Trigger Mechanism |
| 22 | Conductor |
| 24 | Vertical Wall Surface |
| 26 | Counter Top |
| 28 | Safety Belt |
| 30 | Liner Dispenser |
| 32 | Motion Sensor |
| 34 | Push Button Trigger Mechanism |
| 36 | Attachment Lip |

What is claimed is:

1. A baby changing station with prerecorded audio instructions, comprising:

an attachment section adapted for securement to a vertical surface;

a changing station platform pivotally connected to said first section which travels between a first closed position and a second open position of use, wherein in said second open position said changing platform is in a substantially horizontal position for supporting an infant; and means for providing an audio message comprising a means for storing said audio message, a triggering mechanism and a speaker.

2. The changing station of claim 1, wherein said triggering mechanism activates said audio message when said changing station platform is moved with respect to said attachment section.

3. The changing station of claim 2, wherein said triggering mechanism deactivates said audio message when said changing station platform is in said first closed position.

4. The changing station of claim 2, wherein said triggering mechanism is a motion sensor.

5. The changing station of claim 1, wherein said triggering mechanism is a button or switch activated by a user of said changing station.

6. The changing station of claim 1, wherein said means for storing said audio message comprises a programmable microprocessor.

7. An infant changing station with self contained audio instructions comprising:

an attachment member adapted for interconnection to a vertical surface, said attached member having an upper end, a lower end, a front surface and a back surface;

a support platform hingedly interconnected to said lower end of said attachment member, said support platform having an upper end, a lower end, an outer surface, and an inner surface adapted for supporting an infant, said support platform capable of traveling between a first closed position, wherein said support platform is substantially adjacent said attachment member, and a second open position, wherein said support platform is positioned substantially horizontal for supporting the infant;

an audio message means interconnected to said infant changing station for providing a predetermined audio message; and a triggering means in communication with said audio message means, wherein upon activation said audio message is played.

8. The infant changing station of claim 7, wherein said triggering means is interconnected proximate to a hinge pint of said support platform and said attachment member, wherein when said support platform is lowered, said voice instructions are activated.

9. The infant changing station of claim 7, wherein said audio message means is positioned within said support platform.

10. The infant changing station of claim 7, wherein said triggering means is a motion sensor.

11. The infant changing station of claim 7, wherein said audio message means can be selectively changed to provide a new message.

12. The infant changing station of claim 7, wherein said audio message means has a plurality of different language choices.

13. The infant changing station of claim 7, wherein said audio message means comprises a programmable microchip.

14. An infant changing station with prerecorded voice instructions, comprising:

a support platform adapted for supporting an infant and positioned on an upper surface of a substantially planar counter-top surface;

a message delivery means interconnected to said infant changing station for delivering a prerecorded message to a user of said infant changing station; and a motion sensor in communication with said message delivery means for activating said message delivery means and which detects a user approaching said infant changing station.

15. The infant changing station of claim 14, wherein said triggering means comprises a pressure sensitive button positioned on or proximate to said infant changing station.

16. The infant changing station of claim 14, wherein said message delivery means comprises at least a microprocessor, a speaker, a power source, and a recording means for recording and selectively reproducing a predetermined message.

17. The infant changing station of claim 16, wherein said power source comprises one or more batteries.

18. The infant changing station of claim 14, further comprising a video means for providing video information related to an operation of said infant changing station.

19. An infant changing station with prerecorded voice instructions, comprising:

a support platform adapted for supporting an infant and positioned on an upper surface of a substantially planar counter-top surface;

a message delivery means interconnected to said infant changing station for delivering a prerecorded message to a user of said infant changing station; and a triggering means in communication with said message delivery means for activating said message delivery means; and a video means operably interconnected to said triggering means for providing video information related to an operation of said changing station.

* * * * *